US008860617B1

(12) United States Patent
Fenick

(10) Patent No.: US 8,860,617 B1
(45) Date of Patent: Oct. 14, 2014

(54) MULTIBAND EMBEDDED ANTENNA

(75) Inventor: John E. Fenick, Aliso Viejo, CA (US)

(73) Assignee: Trivec-Avant Corporation, Huntington Beach, CA (US)

( * ) Notice: Subject to any disclaimer, the term of this patent is extended or adjusted under 35 U.S.C. 154(b) by 319 days.

(21) Appl. No.: 13/179,451

(22) Filed: Jul. 8, 2011

(51) Int. Cl.
*H01Q 1/00* (2006.01)
*H01Q 5/01* (2006.01)
*H01Q 9/06* (2006.01)

(52) U.S. Cl.
USPC ..... 343/730; 343/729

(58) Field of Classification Search
USPC ..... 343/729, 730, 833
See application file for complete search history.

(56) References Cited

U.S. PATENT DOCUMENTS

| | | | | |
|---|---|---|---|---|
| 2,437,244 | A * | 3/1948 | Dallenbach | 343/767 |
| 2,510,698 | A | 6/1950 | Johnson | |
| 3,449,751 | A | 6/1969 | Schroeder | |
| 3,521,286 | A | 7/1970 | Kuecken | |
| 3,587,102 | A | 6/1971 | Czerwinski | |
| 3,771,157 | A | 11/1973 | Stang | |
| 3,774,220 | A | 11/1973 | Martin et al. | |
| 4,100,546 | A | 7/1978 | Campbell et al. | |
| 4,117,490 | A | 9/1978 | Arnold et al. | |
| 4,426,649 | A * | 1/1984 | Dubost et al. | 343/700 MS |
| 5,289,198 | A | 2/1994 | Alshuler | |
| 5,621,421 | A | 4/1997 | Kolz et al. | |
| 5,745,081 | A | 4/1998 | Brown et al. | |
| 5,952,976 | A | 9/1999 | Giacino et al. | |
| 6,650,301 | B1 * | 11/2003 | Zimmerman | 343/803 |
| 6,947,007 | B1 * | 9/2005 | Rohde et al. | 343/804 |
| 7,075,493 | B2 | 7/2006 | Azadegan et al. | |
| 7,102,577 | B2 | 9/2006 | Richard et al. | |
| 7,298,330 | B2 | 11/2007 | Forster et al. | |
| 7,298,343 | B2 | 11/2007 | Forster et al. | |
| 7,307,591 | B2 | 12/2007 | Zheng | |
| 7,358,906 | B2 * | 4/2008 | Sato et al. | 343/702 |
| 2005/0140562 | A1 * | 6/2005 | Foltz et al. | 343/795 |
| 2008/0024308 | A1 * | 1/2008 | Forster et al. | 340/572.7 |
| 2010/0188303 | A1 * | 7/2010 | Koh et al. | 343/725 |
| 2011/0109524 | A1 * | 5/2011 | Saily | 343/893 |

FOREIGN PATENT DOCUMENTS

| | | |
|---|---|---|
| CN | 1667872 | 9/2005 |
| JP | 2005-203878 | 7/2005 |
| WO | WO 2009/111619 | 9/2009 |

* cited by examiner

*Primary Examiner* — Michael C Wimer
*Assistant Examiner* — Michael Bouizza
(74) *Attorney, Agent, or Firm* — Knobbe, Martens, Olson & Bear, LLP

(57) ABSTRACT

A multiband antenna includes one or more first antennas embedded within a second antenna. The one or more first antennas can include a folded dipole, and the second antenna can include a monopole. The folded dipole and the monopole may operate at different resonant frequencies. Because the folded dipole is embedded in the monopole, rather than being a separate antenna, near-field coupling between the antennas may be reduced, resulting in enhanced radiation patterns by one or both antennas. More complex antenna structures can also be constructed having multiple antennas embedded within one or more antennas.

20 Claims, 5 Drawing Sheets

MULTIBAND EMBEDDED ANTENNA

BACKGROUND

An antenna can include one or more structural electrical elements each providing a bi-directional transition between a guided electrical wave and a free-space propagating wave. A resonant frequency of an antenna can be related to the electrical length of the antenna. Often, an antenna is tuned for a specific resonant frequency and may be effective for a range of frequencies usually centered around the resonant frequency. Other properties of antennas, such as radiation pattern and impedance, change with frequency.

Typically, an antenna is designed for efficient operation over a certain band of frequencies. The antenna size is related to the wavelength of radiation that the antenna is supposed to receive or transmit. An efficient dipole antenna can be constructed with a size of $\lambda/2$, where $\lambda$ represents a wavelength corresponding to the resonant frequency of the antenna. A monopole type of antenna at $\lambda/4$ length is efficient if mounted on an adequately large ground plane or if supplied with radials, which can be wires or other conductors disposed perpendicular to the monopole (e.g., on or in the ground). The $\lambda/4$ antennas are the most prevalent type used in handheld devices such as mobile communication devices, e.g., cell phones. Full $\lambda$ antennas are usually not practical since they are too long at the frequencies of interest. For example, the length of a 30 MHz one $\lambda$ antenna is 10 meters, which is too large for most mobile platforms.

Communication antennas, including those for vehicles, are generally adapted to receive and/or transmit signals in a particular frequency range. The antennas are sized and configured in order to optimize efficiency at particular frequency ranges. Further, the challenge to miniaturize electronic components also applies to antenna design where the antenna's physical dimensions are strongly linked to the component's performance. As the physical size of communication devices shrink, manufacturers are compelled to shrink the size of the antenna systems as well.

SUMMARY

[This section depends on the claims and will be completed when the claims are finalized.]

Certain aspects, advantages and novel features of the inventions are described herein. It is to be understood that not necessarily all such advantages may be achieved in accordance with any particular embodiment of the inventions disclosed herein. Thus, the inventions disclosed herein may be embodied or carried out in a manner that achieves or selects one advantage or group of advantages as taught herein without necessarily achieving other advantages as may be taught or suggested herein.

BRIEF DESCRIPTION OF THE DRAWINGS

Throughout the drawings, reference numbers can be reused to indicate correspondence between referenced elements. The drawings are provided to illustrate embodiments of the inventions described herein and not to limit the scope thereof.

DETAILED DESCRIPTION

Introduction

Military, law enforcement and even commercial vehicles may be equipped with communications devices to permit operators to exchange information with a variety of different information services, command and control or dispatch centers, GPS, and other information. Therefore, it is not uncommon for such vehicles to include multiple, separate antennas, each designed to communicate efficiently at a particular frequency range or a few frequency ranges.

It is desirable in some situations for an antenna to be capable of transmitting in multiple frequency ranges using a shared radiating element. Such an antenna may also desirably assume a small footprint that may be implemented and fitted onto a vehicle. Such an antenna may operate on multiple frequency bands, such as two or more frequency bands. As one example, embodiments of the antennas described herein may operate on both UHF (225-450 MHz) and the L-band (960-1220 MHz or 1350-1850 MHz). However, it should be understood that the frequency bands described herein are merely illustrative examples. The antennas described herein can be scaled in size for use on any other frequency band or bands, including, for example, the following bands (IEEE): HF, VHF, S, C, X, $K_u$, K, $K_a$, Q, V, and W, among other bands, including bands not having any particular letter designation.

Examples of Currently Available Antenna Systems

Figures 1, 2, 3, 4:
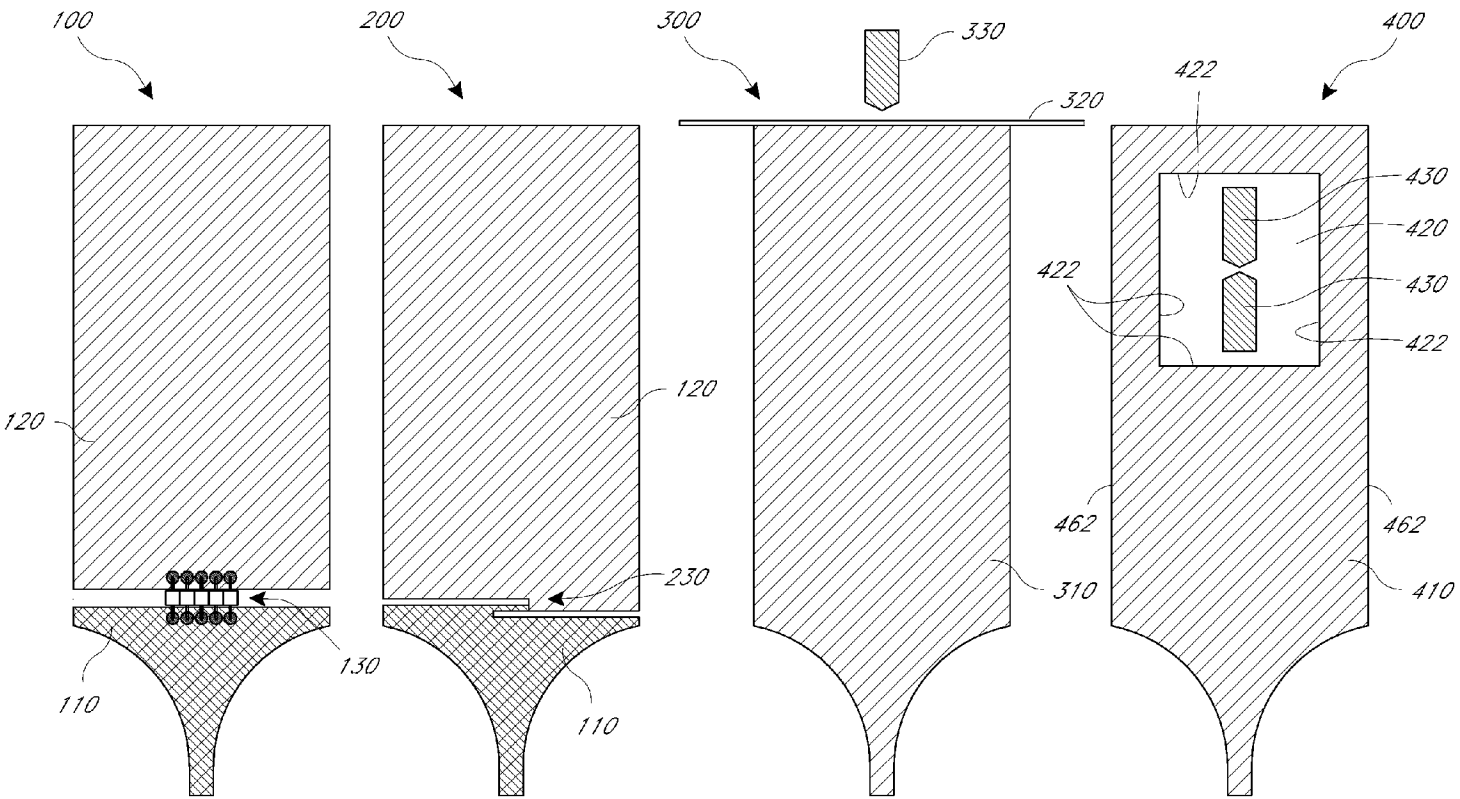
FIG. 4 PRIOR ART
FIG. 3 PRIOR ART
FIG. 2 PRIOR ART
FIG. 1 PRIOR ART
FIGS. 1-4 illustrate example prior art multiband antenna configurations.

Some existing multiband antennas, such as those shown in FIGS. 1 and 2, include a small monopole element 110 resonant at a higher frequency band with an extension 120 of the element such that the entire structure 100 resonates at a lower band. The connection to the extension 120 is typically enabled through discrete reactive lumped components 130 such as inductors and capacitors (see for example FIG. 1) or distributed reactive components 230 such as gaps, stubs, pads, slots, and the like (see for example FIG. 2). Ferrites or resistors may also be used. These types of multiband antennas generally exhibit gain loss and poor radiation pattern shapes due to the near-field coupling around the connective components whereby the high band frequencies are not well isolated from resonating in the extension element 120. Additionally, the high band radiator in such antennas is a monopole, with an elevation pattern not well centered on the horizon, and a maximum gain elevated to about 30-50 degrees above the horizon. These characteristics are undesirable for most line-of-sight applications.

Another configuration of a multiband antenna, shown in FIG. 3, includes a vertical monopole 310 with top load disposed as a horizontal flat plate 320. The plate 320 is typically also used as a ground plane for a small vertical monopole element 330 above it, resonant at the high band frequency. Disadvantages of such a configuration are the extra height requirement due to an absence of nesting of the elements 310, 330, and the excessive size due to the width (in the 2 dimensions shown in FIG. 3, and also in the direction perpendicular to the drawing) of the plate 320.

Yet another antenna configuration 400 is shown in FIG. 4. This antenna 400 includes a wide, flat lower band monopole element 410 (suitable for mounting in an airborne blade-shaped radome, for example) with a window 420 cut in the element 410. The low band current distribution in such a configuration concentrates at the edges 462 of the flat element 410 due to skin effect, and the window 420 therefore has little effect on the low band performance. A high band element 430, which is a dipole in this example, may then be placed in the window 420, for example with planar, circuit board construction techniques. The high band "window" antenna 430, although physically and electrically isolated from the low band element 410, couples in its near-field to the window edges 422, and the energy is re-radiated to produce a poorly shaped, composite far-field pattern in the high band.

Example Multiband Embedded Antennas

A folded dipole is a type of antenna configuration that may be used to control impedance level and other parameters. Unlike a single conductor dipole, a folded dipole may include a second conductor connected in parallel to the first conductor. The configuration of a folded dipole can appear like a wide flat loop with the feed in the center of the first conductor. The length of a folded dipole can be approximately a half wavelength at the resonant frequency. The impedance of the folded dipole can be adjusted by varying the spacing of the parallel conductor and the widths or diameters of the conductors. The folded dipole may be used when it is desired to raise the impedance of the antenna. In some instances, it is desirable to use a partially-folded dipole, where the parallel conductor section is shorter than the primary conductor section and where the parallel section connects to the primary section somewhere short of the very top of the primary section. This configuration may provide more flexibility in impedance matching. Folded dipoles and folded monopoles can sometimes be used to provide a DC short to ground for various purposes, such as static drain and lightning protection.

Figure 5:
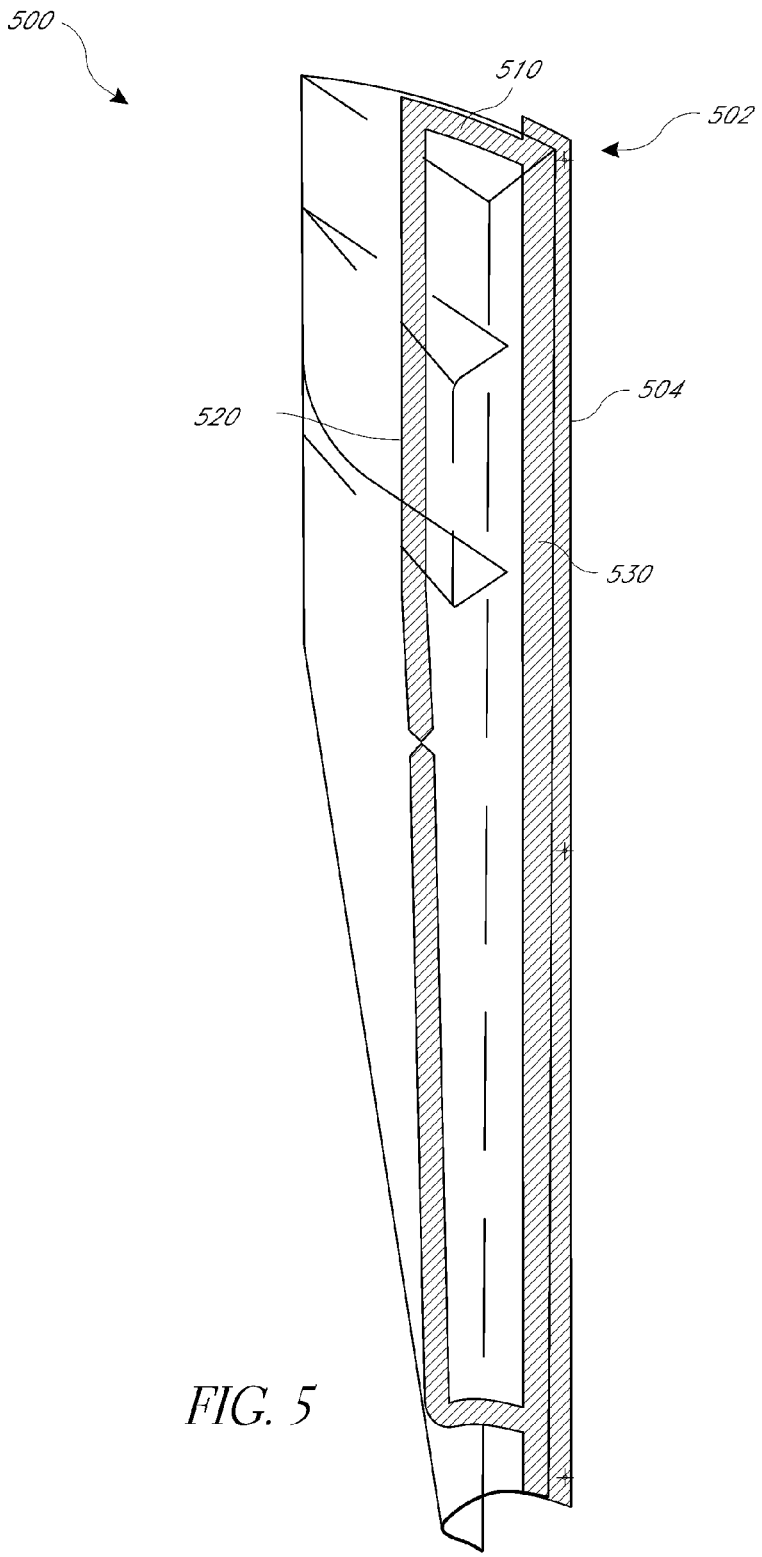
FIG. 5 illustrates an embodiment of a multiband embedded antenna.

Referring to FIG. 5, an example metallic structure 500 is shown, suitable for implementing a multiband antenna 502. The structure 500 is an example blade of an aircraft, such as a helicopter vertical tail spar. The structure 500 includes a multiband antenna 502 having a primary element 504 and a folded dipole element 510. The primary element 504 includes a single conductor. The folded dipole element 510 includes two parallel portions 520, 530 of the single conductor.

In some embodiments, to obtain a second resonance with the multiband antenna 502, the folded dipole element 510 is positioned inside the area of the primary element 504. The folded dipole element 510 may be approximately a half wavelength long at the desired second resonant frequency. The pattern and impedance of the folded dipole element 510 can be adjusted by varying the width of the loop defined by the portions 520, 530 of the conductor and the widths or diameters of the portions 520, 530 themselves.

In this way, a dipole mounted close to a helicopter tail, such as in a leading or trailing edge fairing, can excite the tail as a part of the radiating system, which can help maintain the symmetry of the radiation pattern. Similar patterns can be implemented in other aircraft, including airplanes, unmanned drones, spacecraft, and weather balloons. In various embodiments, a multiband antenna can be embedded in any metal structure used in a vehicle, including land-based vehicles (trucks, cars, etc.), marine vehicles (such as naval vessels), airborne vehicles, and the like. The antennas described herein may be used for military communications (including radar, jamming, or the like) and civilian applications, including amateur (HAM) radio and marine radio. Further, the multiband antennas described herein may be implemented independent of a vehicle, for example, on the ground or on a building.

More generally, an antenna can be embedded in a second antenna of lower resonance frequency, whereby each operates independently and with reduced mutual interaction and interference. For example, a folded dipole may be embedded in a monopole antenna to create a multiband antenna having these characteristics. However, antennas other than folded dipoles may also be embedded in a monopole or other antennas. Examples are described below.

Figure 6:
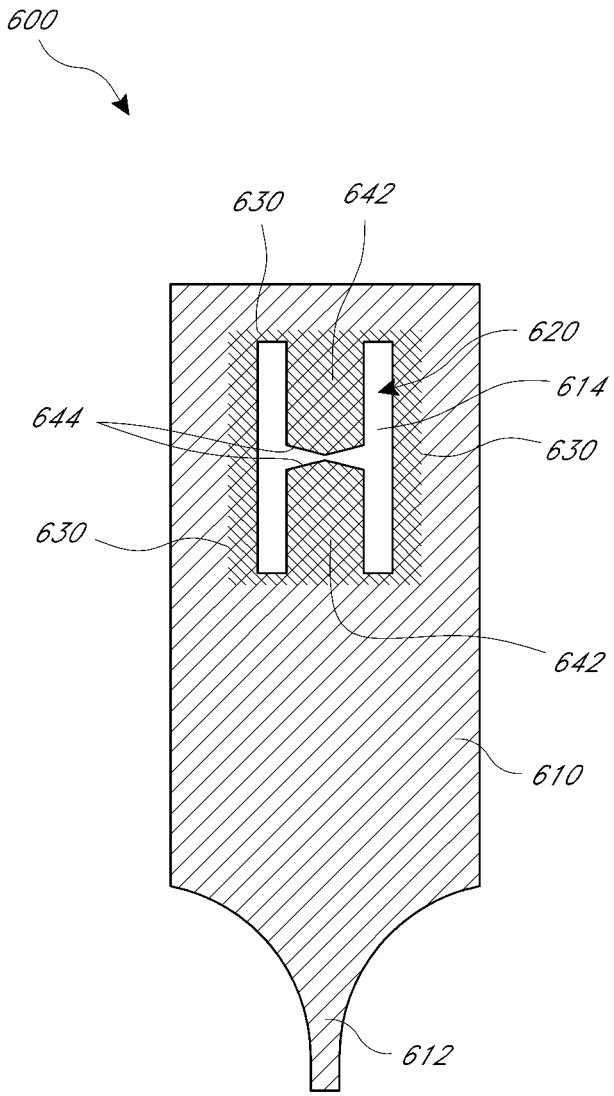
FIG. 6 illustrates an embodiment of a folded dipole element embedded in a monopole element.
Figure 9:
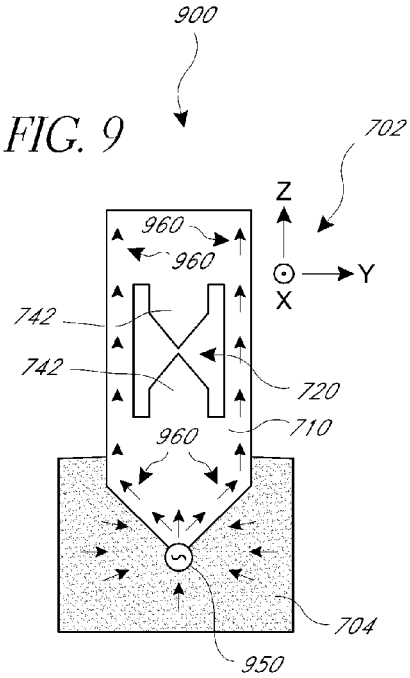
FIG. 9 illustrates example current flow in an embodiment of a monopole element and ground plane.

Referring to FIG. 6, an example multiband antenna 600 is shown that includes a folded dipole 620 embedded into a monopole 610. The monopole 610 in the depicted embodiment has a flat blade structure. For ease of illustration, a ground plane associated with the monopole 610 is not shown (see FIGS. 7 and 9). As illustrated in FIG. 6, the embedded dipole 620 resembles an approximately "H" shaped slot cut in the monopole 610. The dipole 620 includes protruding conductors 642 that protrude in the window 614 to create this "H" shape. The protrusions or conductors 642 do not physically touch in certain embodiments. A feed line can be connected to the conductors 642 in the center of the "H" in some embodiments (see, e.g., FIG. 7). As shown, edges 644 of the protruding conductors 642 may be tapered. In other embodiments, these edges 644 may be flat and therefore parallel with one another, or they may be rounded, or have some other shape.

Advantageously, in certain embodiments, by embedding the folded dipole 620 into a flat blade monopole 610, rather than placing a dipole in a window electrically isolated from the monopole 610 (such as in FIG. 4), the multiband antenna 600 may be excited symmetrically as a whole frequencies, producing a symmetric radiation pattern at high and/or low frequencies. Further, what would be the edges of a window, if the dipole 620 ends did not connect to the blade element 610, may therefore now include fold-back current paths, as illustrated by darkened portion 630. Thus, in one embodiment, the folded dipole 620 can be considered to include a portion of the monopole 610 element, highlighted by the darkened portion 630, as well as the protrusion conductors 642. The folded dipole 620 is therefore integral with or embedded in the monopole 610 in some embodiments.

The actual width or size of the darkened portion 630, representing where a substantial portion of current generated by the folded dipole 620 flows, can depend on the frequency and power of the transmitted (or received) signal. At lower frequencies, the width of this portion 630 can be greater than at higher frequencies. Similarly, at higher power or current, the width of this portion 630 can be greater than at lower power or current. Further, the fold-back current paths may be symmetrical or asymmetrical in some implementations.

The example blade monopole 610 shown includes a tapered portion 612 or tang to which a feed line may be attached (e.g., at the bottom of the tapered portion 612). This tapered portion 612 may have a different shape (see, e.g., FIG. 7) or may be omitted in some embodiments.

Because the monopole 610 is larger than the folded dipole 620 in the depicted embodiment, the monopole 610 may have a lower resonance frequency than the folded dipole 620. Thus, the monopole 610 may operate at a lower frequency band than the folded dipole 620. As described above, the frequency bands at which the monopole 610 and dipole 620 operate can depend on the size of the monopole 610 and dipole 620. As one example, the monopole 610 may operate at UHF (e.g., which may include some frequencies from about 225 to about 450 MHz). The dipole 620 may operate in a microwave band such as the L-band (e.g., which may include some or all frequencies from about 960 to about 1220 MHz and/or about 1350 to about 1850 MHz). These bands are merely examples and can vary in other embodiments. For ease of illustration, the remainder of this specification will refer to the monopole 610 as operating at a relatively lower band compared with the dipole 620, which operates at a relatively higher band due to the difference in size of the two antennas 610, 620.

It should also be understood that while the monopole 610 and the dipole 620 have resonant frequencies about which a band of operation may be utilized, the monopole 610 and/or the dipole 620 may also operate at other bands where resonance is not present. For example, while the monopole 610 or dipole 620 may operate more efficiently in a frequency band centered around a resonant frequency, the monopole 610 and dipole 620 may operate less efficiently at other bands.

Figure 7:
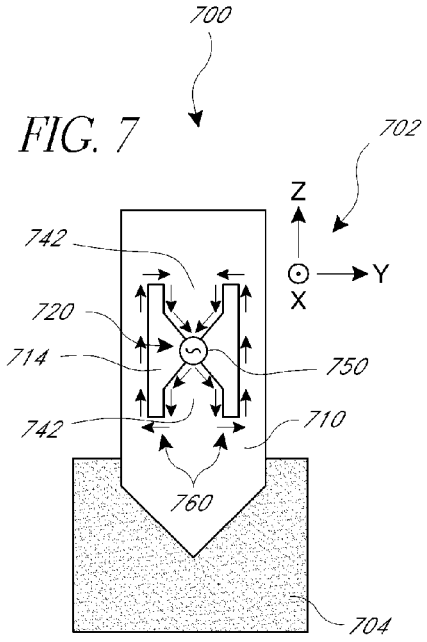
FIG. 7 illustrates example current flow in an embodiment of an embedded folded dipole.

FIG. 7 illustrates another example embodiment of a multiband antenna 700 that includes many of the features of the antenna 600 illustrated with respect to FIG. 6. Other features of the multiband antenna 700 are also shown in addition to those features of the antenna 600. In particular, current paths 760 associated with a folded dipole 720 are depicted. These current paths 760 are shown in contrast with current paths 960 associated with a monopole 710 (see FIG. 9, described below), to illustrate how the current paths 760, 960 have little or no interference with one another.

Like the multiband antenna 600, the example multiband antenna 700 shown includes a monopole blade 710 and a dipole 720. The monopole blade 710 is shown connected to or above a ground plane 704. The ground plane 704 may be replaced with radials in some embodiments. The monopole blade 710 and ground plane 704 are shown schematically. In an actual implementation, a normal line to the ground plane 704 may be parallel or approximately parallel with the monopole blade 710. Although the monopole includes both a blade 710 and A ground plane 704 in some embodiments, this specification refers to the blade 710 and the monopole interchangeably for ease of description.

A voltage source or feed 750 is shown connected to protruding conductors 742 of the folded dipole 720. The feed 750 supplies a voltage or current signal to be transmitted by the folded dipole 720. Although not shown, the feed 750 may be connected to antenna tuning circuitry or the like, or no antenna tuning may be used in some cases. The feed 750 may be modeled as a current source in some implementations.

Current 760 output by the feed 750 is shown exiting the feed 750 and circulating around the folded dipole 720. Due to the skin effect present in conductors at alternating current, the current 760 is substantially contained to an area surrounding a window 714 formed by the folded dipole 720. This area corresponds to the shaded area 630 of FIG. 6. In contrast, referring to the FIG. 9, current 960 output by a feed 950 associated with the monopole 710 is pushed to the outside region 962 of the monopole 710 due to the skin effect. The current 760 from the dipole 720 and the current 960 from the monopole 710 therefore are substantially independent and do not interfere with each other, or interfere only slightly. Further, because the folded dipole 720 is integrally embedded with the monopole 710 in certain embodiments, rather than being entirely within a window, the folded dipole 720 may experience reduced near-field coupling with the monopole 710, or little or no coupling at all. As a result, the multiband antenna 700 may have enhanced radiation patterns.

Figure 8:
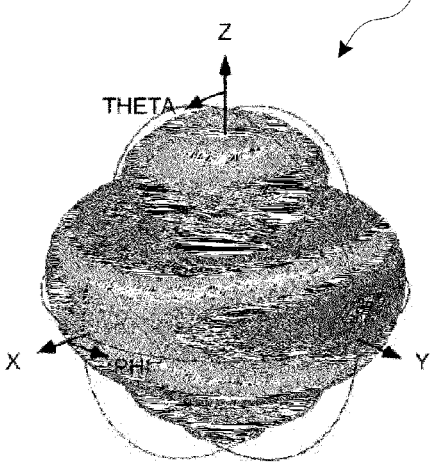
FIG. 8 illustrates an example radiation pattern of the antenna embodiment of FIG. 7.
Figure 10:
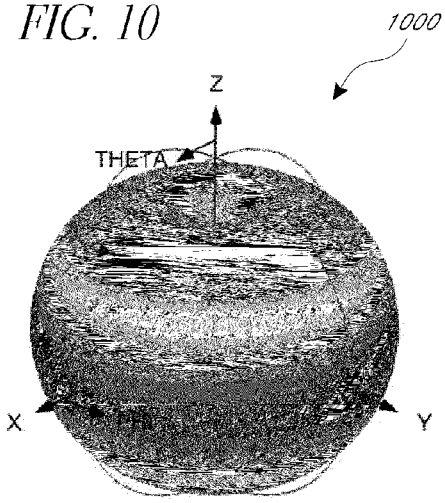
FIG. 10 illustrates an example radiation pattern of the antenna embodiment of FIG. 10.

Example radiation patterns 800, 1000 corresponding to the dipole 720 and the monopole 710 are shown in FIGS. 8 and 10, respectively. Referring to FIG. 8, the example radiation pattern 800 corresponding to the dipole 720 includes a relatively strong output at low elevation angles, including at 0 degrees elevation and in a band around 0 degrees. This output may also be symmetric in certain embodiments or may have at least some directivity azimuthally. At least some directivity in elevation (in the E-plane) is also present. Nulls or attenuated regions are reduced along this region. The gain at the horizon (in the X-Y plane) of the dipole antenna in some configurations may be between about 2.5 and about 4 dBi at a frequency of 1250 MHz. The radiation pattern 1000 corresponding to the monopole 710 in FIG. 10 also includes relatively symmetric, strong and/or uniform output at low elevation angles as well as at higher elevation angles. The gain around the horizon of the monopole antenna for some configurations may be about 1.5 dBi at a frequency of 225 MHz. The axes used in FIGS. 8 and 10 correspond to axes 702 shown in FIGS. 7 and 9.

In certain embodiments, the shape of one or both of the radiation patterns 800, 1000 is affected by the position of the dipole 720 with respect to the monopole 710. Embedding the dipole 720 near the top of the monopole 710, for instance, rather than near the root (as in the antennas of FIGS. 1 and 2) of the monopole 710, can raise the dipole 720 off the antenna mounting ground plane 704. Doing so may provide a superior pattern 800 and/or 1000 with enhanced radiation at the horizon level without having multipath nulls or notches at low elevation angles.

Additional Embodiments

FIGS. 11 through 14 illustrate some additional example embodiments of multiband embedded antennas 1100-1400. Many other variations of the antennas described herein may also be implemented.

Figure 11:
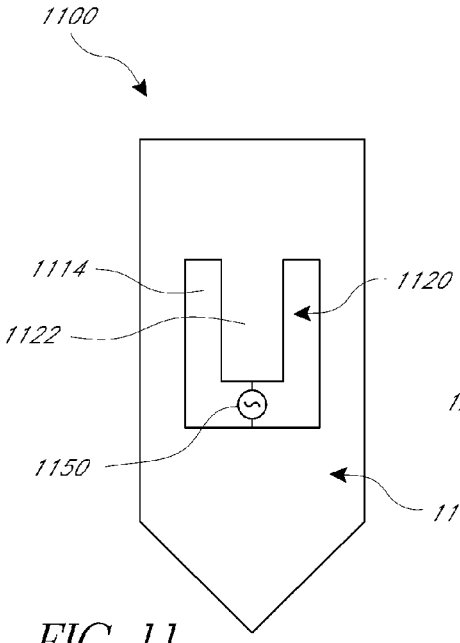
FIGS. 11 through 14 illustrate additional example embodiments of multiband embedded antennas.

FIG. 11 illustrates a multiband antenna 1100 having a monopole 1110 (with ground plane omitted for ease of illustration) and another embedded antenna 1120. The embedded antenna 1120 is an end-fed folded dipole 1120 having a single protruding conductor 1122 into a window 1114. A feed point 1150 connects to the protrusion 1122 and to a surface of the monopole 1110. The dipole 1120 may also radiate current substantially in a band around the window 1114. The multiband antenna 1100 may have similar benefits to those described above.

Figure 12:
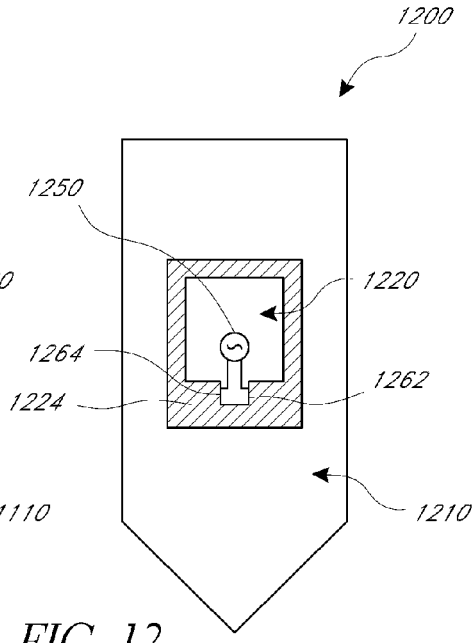

FIG. 12 illustrates a multiband antenna 1200 having a monopole 1210 (with ground plane omitted for ease of illustration) and another embodiment of an embedded antenna 1220. In this embodiment, the embedded antenna 1220 is a loop antenna 1220. The loop antenna 1220 comprises a portion 1224 of the conductive element of the monopole 1210, shaded for ease of illustration. This shaded portion 1224 represents approximately where a substantial amount of current associated with the loop antenna 1220 flows. A feed point 1250 connects to surfaces 1262, 1264 of the portion 1224 of the conductive element. The multiband antenna 1200 may have similar benefits to those described above.

Figure 13:
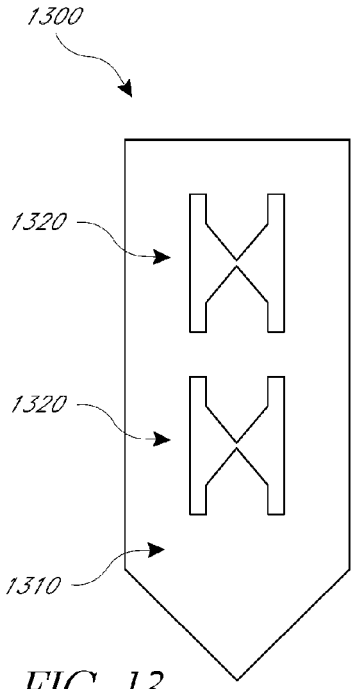

FIG. 13 illustrates a multiband antenna 1300 having a monopole 1310 (with ground plane omitted for ease of illustration) and multiple embedded antennas 1320, one on top of another. The embedded antennas 1320 are dipoles in the depicted embodiment but could instead be loop antennas or other types of antennas. The dipoles 1320 may have the same size and operate as a high band array. In other embodiments, the dipoles 1320 have different sizes for operating in different bands. The multiband antenna 1300 may have similar benefits to those described above.

Figure 14:
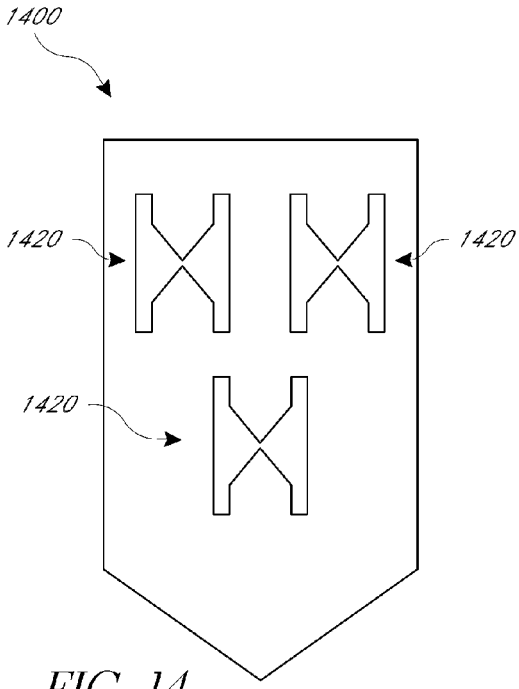

FIG. 14 illustrates a multiband antenna 1400 having a monopole 1410 (with ground plane omitted for ease of illustration) and multiple embedded antennas 1420, side-by-side and above and below one another. The embedded antennas 1420 are dipoles in the depicted embodiment but could instead be loop antennas or other types of antennas. The dipoles 1420 may have the same size and operate as a high band array. In other embodiments, the dipoles 1420 have different sizes for operating in different bands. The multiband antenna 1400 may have similar benefits to those described above.

Although not shown, in other embodiments, a multiband antenna may include a low band folded monopole. Further, a folded dipole used in any of the antennas described herein may instead have protruding conductors of unequal length, therefore providing an off-center fed dipole. Moreover, a folded dipole may be embedded within one or more blades of a blade dipole as well. This blade dipole may be a folded dipole itself. More complex nested structures may also be created, with multiple folded dipoles or other antennas nested within monopoles, dipoles, loop antennas, Yagis, horns, parabolic dishes, or other antenna structures.

Terminology

Although the inventions disclosed herein have been described in the context of certain embodiments and examples, it should be understood that the inventions disclosed herein extend beyond the specifically disclosed embodiments to other alternative embodiments and/or uses of the inventions and certain modifications and equivalents thereof. Further, the disclosure herein of any particular feature, aspect, method, property, characteristic, quality, attribute, element, or the like in connection with an embodiment may be used in all other embodiments set forth herein. Thus, it is intended that the scope of the inventions disclosed herein should not be limited by the particular disclosed embodiments described above. As will be recognized, certain embodiments of the inventions described herein can be embodied within a form that does not provide all of the features and benefits set forth herein, as some features can be used or practiced separately from others.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

What is claimed is:

1. An antenna apparatus comprising:

a monopole antenna configured to operate in a first frequency band, the monopole antenna comprising an outer boundary along an exterior of the monopole antenna and an inner boundary within an interior of the monopole antenna, wherein the inner boundary comprises a top side and a bottom side below the top side, and wherein the inner boundary forms an enclosed window; and a folded dipole antenna configured to operate in a second frequency band that is higher than the first frequency band, the folded dipole antenna comprising a first conductor and a second conductor, wherein the folded dipole antenna is positioned within and physically coupled to the interior of the monopole antenna, wherein the first conductor protrudes from the top side of the inner boundary toward a center of the enclosed window, and wherein the second conductor protrudes from the bottom side of the inner boundary toward the center of the enclosed window.

2. The antenna apparatus of claim 1, wherein the folded dipole antenna and the monopole antenna are configured to operate without substantially interfering with one another.

3. The antenna apparatus of claim 1, wherein the first conductor and the second conductor are coupled in parallel, and wherein the first conductor does not physically touch the second conductor.

4. The antenna apparatus of claim 1, further comprising a feed port connected to the first conductor and the second conductor in the center of the enclosed window.

5. The antenna apparatus of claim 1, further comprising a ground plane coupled with the monopole antenna.

6. The antenna apparatus of claim 5, wherein the folded dipole antenna is positioned a first distance from the ground plane, wherein the folded dipole antenna, when positioned at the first distance, has an antenna pattern with a first output at lower elevation angles, wherein the folded dipole antenna, when positioned at a second distance from the ground plane, has an antenna pattern with a second output at lower elevation angles, wherein the second distance is shorter than the first distance, and wherein the first output is enhanced when compared to the second output.

7. The antenna apparatus of claim 1, wherein the first conductor and the second conductor protrude into the window such that the window comprises an "H"-shaped configuration.

8. The antenna apparatus of claim 1, wherein the monopole antenna generates a first flow of current along the outer boundary of the monopole antenna, wherein the folded dipole antenna generates a second flow of current along the inner boundary of the monopole antenna, and wherein the first flow of current and the second flow of current do not overlap.

9. The antenna apparatus of claim 1, further comprising a feed port connected to the monopole antenna.

10. An antenna apparatus comprising:

a monopole antenna configured to operate in a first frequency band, the monopole antenna comprising an outer boundary along an exterior of the monopole antenna and an inner boundary within an interior of the monopole antenna, wherein the inner boundary comprises a top side and a bottom side below the top side, and wherein the inner boundary forms an enclosed window; and a first antenna configured to operate in a second frequency band that is higher than the first frequency band, the first antenna comprising a first conductor and a second conductor, wherein the first antenna is positioned within and physically coupled to the interior of the monopole antenna, wherein the first conductor protrudes from the top side of the inner boundary toward a center of the enclosed window, and wherein the second conductor protrudes from the bottom side of the inner boundary toward the center of the enclosed window.

11. The antenna apparatus of claim 10, wherein the first antenna comprises a dipole.

12. The antenna apparatus of claim 10, wherein the first antenna comprises a folded dipole.

13. The antenna apparatus of claim 10, wherein the monopole antenna comprises a second inner boundary within the interior of the monopole antenna, wherein the second inner boundary forms a second window.

14. The antenna apparatus of claim 13, further comprising a second antenna positioned within the interior of the monopole antenna, wherein the second antenna comprises a third conductor that protrudes from the monopole antenna into the second window.

15. The antenna apparatus of claim 14, wherein the second antenna comprises a loop antenna.

16. The antenna apparatus of claim 14, wherein the first antenna and the second antenna are configured in an array.

17. The antenna apparatus of claim 14, wherein the first antenna comprises a first shape, wherein the second antenna comprises a second shape, wherein the first shape is different from the second shape, wherein the first antenna has a first resonant frequency, and wherein the second antenna has a second resonant frequency different from the first resonant frequency.

18. An antenna apparatus comprising:

a monopole antenna configured to operate in a first frequency band, the monopole antenna comprising an outer boundary along an exterior of the monopole antenna and an inner boundary within an interior of the monopole antenna, wherein the inner boundary forms a window, wherein the monopole antenna is configured to receive a first flow of current; and a folded dipole antenna configured to operate in a second frequency band that is higher than the first frequency band, the folded dipole antenna comprising a first conductor and a second conductor, wherein the folded dipole antenna is positioned within and physically coupled to the interior of the monopole antenna, wherein the first conductor and the second conductor protrude into the window, and wherein the folded dipole antenna is configured to receive a second flow of current that does not substantially interfere with the first flow of current.

19. The antenna apparatus of claim 18, wherein the monopole antenna is configured to receive the first flow of current along the outer boundary of the monopole antenna, and wherein the folded dipole antenna is configured to receive the second flow of current along the inner boundary of the monopole antenna.

20. The antenna apparatus of claim 18, wherein the first flow of current and the second flow of current are configured to have reduced interference as compared with a second monopole antenna having a second dipole antenna placed therein that is electrically isolated from the second monopole antenna.

* * * * *